US006422388B1

(12) United States Patent
McCahey

(10) Patent No.: US 6,422,388 B1
(45) Date of Patent: Jul. 23, 2002

(54) DECORATIVE CONTAINER

(75) Inventor: Theresa Ann McCahey, Hastings, MN (US)

(73) Assignee: Boxtioue, Inc., Hastings, MN (US)

( * ) Notice: Subject to any disclaimer, the term of this patent is extended or adjusted under 35 U.S.C. 154(b) by 0 days.

(21) Appl. No.: 09/507,541

(22) Filed: Feb. 18, 2000

(51) Int. Cl.[7] ..... B65D 73/00
(52) U.S. Cl. ..... 206/457; 229/87.19; 229/923
(58) Field of Search ..... 206/457, 8, 216; 229/87.19, 923; 493/92, 95, 94

(56) References Cited

U.S. PATENT DOCUMENTS 1,154,457 A * 9/1915 Taylor
1,701,954 A * 2/1929 Lowe
2,374,160 A * 4/1945 Marienthal
4,067,493 A * 1/1978 Stavin ..... 206/8
4,732,269 A * 3/1988 Roy ..... 206/566
5,044,547 A * 9/1991 Hartman ..... 229/87.19
5,400,917 A * 3/1995 Stanton ..... 220/612
5,529,395 A * 6/1996 French ..... 229/87.19

* cited by examiner

*Primary Examiner*—David T. Fedei
(74) *Attorney, Agent, or Firm*—Jonathan Spangler

(57) ABSTRACT

The present invention relates to a container for receiving gift cards during special events, as well as for storing additional keepsake articles after the special event. The container of the present invention includes an article-receiving member and a lid member. The article-receiving member has a decorative exterior, and a decorative and protective interior. The lid member has a decorative exterior. Collectively, the lid member and article-receiving member provide an attractive receptacle of high quality for receiving gift cards during special events, such as those brought by attendees of weddings, anniversary parties, baptisms, birthday parties, bat mitzvahs, bar mitzvahs, wedding and/or baby showers. Following the special event, the container of the present invention may be used to store additional keepsakes from the special event in a safe condition, and is suitably attractive to be placed prominently for public viewing.

52 Claims, 8 Drawing Sheets

DECORATIVE CONTAINER

BACKGROUND OF THE INVENTION

I. Field of the Invention

The present invention relates generally to containers for storing articles. More particularly, the present invention relates to a decorative container for receiving gift cards during special events and for long-term storage of additional keepsakes from the special event.

II. Discussion of the Prior Art

During special events (including but not limited to weddings, anniversary parties, baptisms, birthday parties, bat mitzvahs, bar mitzvahs, wedding and/or baby showers), it has become increasingly common to use a box, receptacle, or container to receive gift cards brought by attendees. In this fashion, the gift cards brought by the attendees of the special event will be maintained in a convenient and tidy fashion within the box during the special event. During a wedding, for example, such a card-box may be located at the back of the church on a table so that the attendees may deposit their gift cards in the card-box on their way to their seat. In similar fashion, a card box may be located on a gift table, such as during a reception or party. The use of a card-box thus prevents the unsightly cluttering that would otherwise occur if the gift cards were simply placed in a pile on the table, as opposed to being deposited in a card-box.

To date, the boxes or receptacles employed for receiving gift cards at special events have suffered from various drawbacks. First, these prior art card-receptacles are typically of very poor quality and not terribly attractive. This is because, in practice, people typically overlook the need for such a card-box until the last minute and then end up using common containers, such as bowls, baskets, flowerpots, mail-boxes, and even bird-cages, to collect gift cards during special events. Another drawback is that, while the outside of such receptacles may be decorative in nature, the insides are rarely equipped in a decorative fashion such that attendees may find the "overall" appearance of the card-box to be unattractive. A further drawback exists in that these prior art receptacles only serve the single purpose of receiving gift cards during the special events. That is to say, they do not lend themselves for long-term storage of the gift cards, or other keepsakes from the special event. By way of example only, when the special event is a wedding, such keepsakes may include (but are not necessarily limited to) jewelry, garters, gift cards, certificates, and/or wedding cake topper from the wedding. One reason the prior art card-boxes do not lend themselves to long-term storage of such articles is that they are not equipped with any mechanism to protect the contents thereof from damage during transportation and/or storage. That is to say, the inside of such prior art card-boxes are typically unfurnished such that the keepsake articles disposed therein may impinge upon the walls thereof during transportation and become damaged. Another reason the prior art card-boxes do not lend themselves to long-term storage of keepsakes is (once again) because of their modest attractiveness, which typically relegates them to storage in attics, closets, or other places out of public viewing.

The present invention is directed at eliminating, or at least reducing, the foregoing drawbacks associated with the prior art.

BRIEF SUMMARY OF THE INVENTION

In one broad aspect of the present invention, a container is provided comprising an article-receptacle and a lid member. The article-receptacle has at least one wall member extending from a bottom member defining an outside surface and an inside surface. The outside surface of the article-receptacle is equipped with a decorative covering. The inside surface of the article-receptacle being equipped with a decorative and protective covering such that the article-receptacle may be employed during special events to receive gift cards brought by attendees of the special event. The lid member has a decorative covering and is dimensioned to fit over the article-receptacle to selectively maintain the gift cards and other keepsake articles from the special event in a secure fashion therewithin.

In a further broad aspect of the present invention, a container is provided for storing keepsake articles from a special event. The container comprises an article-receiving member and a lid member. The article-receiving member has an outside surface and an inside surface, with the inside surface defining an article-receiving portion therein. The outside surface has a decorative appearance. The inside surface has a decorative and protective covering such that the article-receiving portion is attractive and serves to protect keepsake articles disposed therein during transportation. The lid member is for selectively covering the article-receiving member to selectively maintain the keepsake articles in a safe and protected condition within the article-receiving portion.

Still another broad aspect of the present invention involves a method of manufacturing a container for use in storing keepsake articles from a special event. The method includes the steps of (a) providing an article-receptacle having at least one wall member extending from a bottom member defining an outside surface and an inside surface; (b) equipping the outside surface of the article-receptacle with a decorative covering; (c) equipping the inside surface of the article-receptacle with a decorative and protective covering; (d) providing a lid member dimensioned to fit over the article-receptacle to selectively maintain keepsake articles from the special event in a secure fashion therewithin; and (e) equipping the lid member with a decorative covering.

BRIEF DESCRIPTION OF THE DRAWINGS

The following description of the preferred embodiments of the present invention will be better understood in conjunction with the appended drawings, in which.

DETAILED DESCRIPTION OF THE INVENTION

Illustrative embodiments of the invention are described below. In the interest of clarity, all features of an actual implementation may not be described in this specification. It will of course be appreciated that in the development of any such actual embodiment, numerous implementation-specific decisions must be made to achieve the developers' specific goals, such as compliance with business-related constraints, which may vary from one implementation to another. Moreover, it will be appreciated that such a development effort might be complex and time-consuming, but would nevertheless be a routine undertaking for those of ordinary skill in the art having the benefit of this disclosure.

The present invention addresses and overcomes the drawbacks of prior art containers or receptacles for receiving gift cards during special events. The present invention does so by providing a container for receiving gift cards during special events, as well as for storing additional keepsake articles after the special event. The container of the present invention includes an article-receiving member and a lid member. The article-receiving member has a decorative exterior, and a decorative and protective interior. The lid member has a decorative exterior. Collectively, the lid member and article-receiving member provide an attractive receptacle of high quality for receiving gift cards during special events, such as those brought by attendees of weddings, anniversary parties, baptisms, birthday parties, bat mitzvahs, bar mitzvahs, wedding and/or baby showers. Following the special event, the container of the present invention may be used to store additional keepsakes from the special event in a safe condition, and is suitably attractive to be placed prominently for public viewing.

Figure 1:
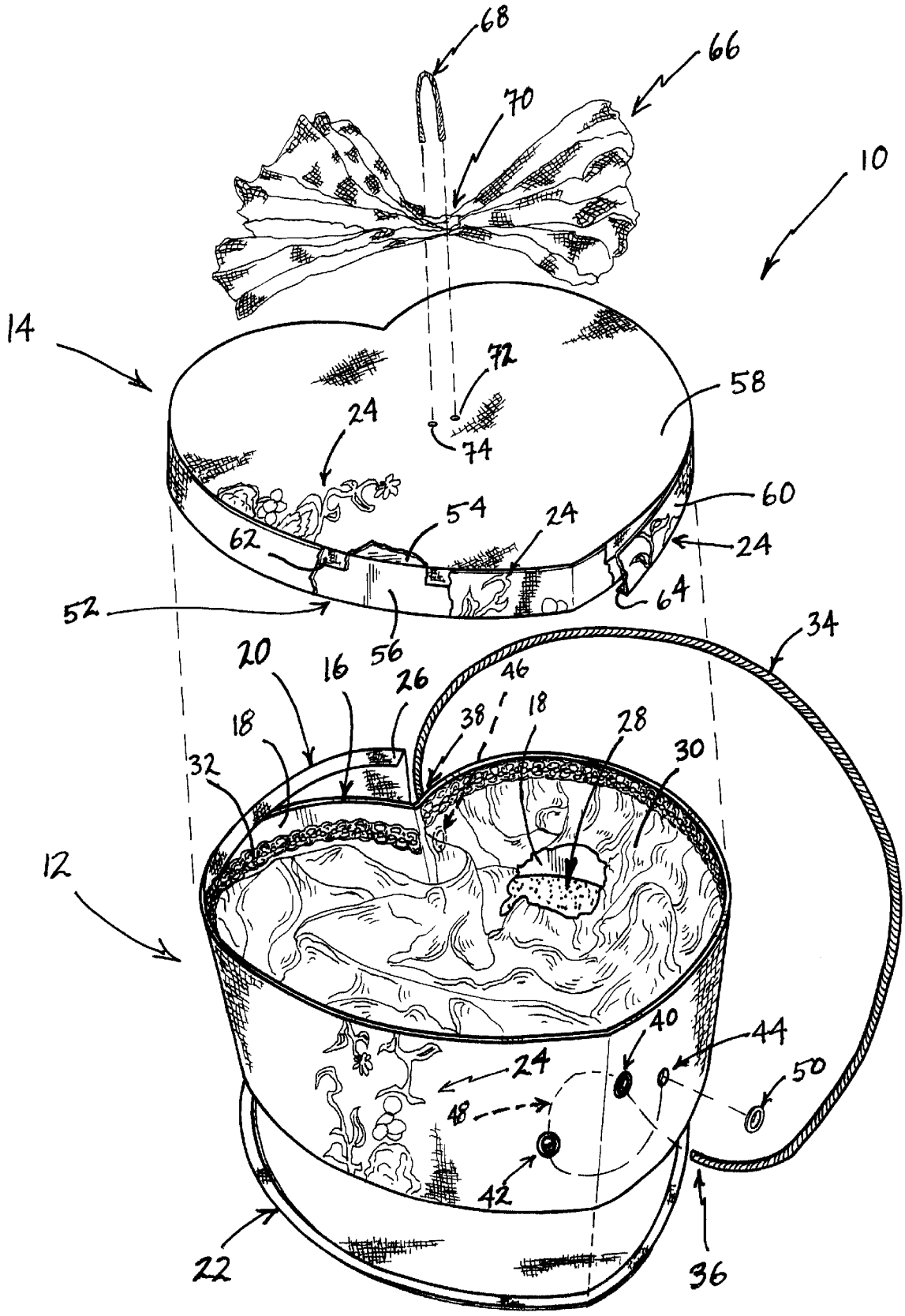
FIG. 1 is a partially exploded perspective view of a decorative container having a generally heart shape according to one embodiment of the present invention.

FIG. 1 illustrates a heart-shaped decorative container 10 according to one embodiment of the present invention. The container 10 includes an article receptacle 12 and a lid member 14. The article receptacle 12 includes a generally heart-shaped box structure 16 for providing structural integrity. The box structure 16 is preferably constructed from cardboard, but may be constructed from any number of other suitable materials for providing such structural integrity, including but not limited to plastic, metal, or wood. The box structure 16 includes a side wall member 18 coupled to a bottom member (not shown). In accordance with the present invention, the box structure 16 is provided with a decorative exterior and an interior that is both decorative and protective.

In one embodiment, a decorative exterior is provided by adhering or otherwise affixing a fabric 20 to the side wall member 18 of the article receptacle 12, and a fabric 22 to the bottom member (not shown) of the article receptacle 12. As shown in FIGS. 1–3 and 6–7, the fabric 20 disposed on the side wall member 18 of the box structure 16 is preferably equipped with a decorative pattern, such as that shown generally at 24. With brief reference to FIG. 4, the same is true of the fabric 22 disposed on the bottom of the article receptacle 12, that is, it is similarly equipped with the decorative pattern 24. By way of example only, the decorative pattern 24 may take the form of a floral print, a striped print and/or a fruit print. The fabric 20, 22 may also be provided in any number of different colors or shades, including but not limited to white and ivory. To facilitate the positioning of the decorative fabric 20 on the box structure 16, a lip 26 may be provided along the upper edge of the fabric 20 to wrap over the upper edge of the wall member 18. The fabric 20, 22 may be affixed or adhered to the box structure 16 in any number of well known fashions, including but not limited to the use of glues, stitching, staples or any other mechanism suitable for securing the fabric 20, 22 to the box structure 16. Although the use of the fabric 20, 22 constitutes the preferred embodiment for creating a decorative appearance on the exterior of the box structure 16, it is within the scope of the present invention to provide such a decorative exterior in any number of different fashions, including but not limited to painting, printing, or stamping decorative designs along the exterior of the box structure 16.

In an important aspect of the present invention, the interior of the box structure 16 is provided with a covering which serves the dual purpose of: (1) providing an attractive outward appearance when the lid member 14 is removed; and (2) providing a protective buffer between the box structure 16 and keepsake articles disposed within the article receptacle 12. In a preferred embodiment, the decorative and protective covering within the article receptacle 12 includes a buffer material 28 disposed along the interior of the box structure 16 (preferably along the bottom thereof) and a fabric liner 30 disposed over the buffer material 28 and affixed along its upper edge to the upper edge of the wall member 18 of the box structure 16. The fabric liner 30 is preferably a material having decorative qualities so as to provide an attractive outward appearance when the lid member 14 is removed from the article receptacle 12. In a preferred embodiment, the fabric liner 30 is a satin material, most preferably a Celanese acetate satin. However, it will be understood that any number of alternate fabrics may be employed without departing from the scope of the present invention. The fabric liner 30 may be affixed or otherwise adhered to the box structure 16 in any number of different fashions, including but not limited to the use of glues, staples, or other affixing mechanisms capable of securing the upper edge of the fabric liner 30 along the upper edge of the wall member 18 of the box structure 16. The buffer material 28 is preferably 100% polyester fiber; however, it is to be readily understood that any number of suitable materials may be employed as the buffer material 28 to provide the desired protective buffering function without departing from the scope of the present invention. To augment the decorative features of the interior of the article receptacle 12, a strip of lace material 32 may be optionally provided along the upper edge of the fabric liner 30 so as to be generally flush with the upper edge of the side wall 18 of the box structure 16. The lace material 32 may be affixed or otherwise adhered to the upper edge of the fabric liner 30 and on the upper edge of the side wall 18 using any number of known fashions, including but not limited to the use of glues, stitching, staples, or other affixing mechanisms capable of securing the lace material 32 to the upper edges of the fabric liner 30 and side wall 18.

The article receptacle 12 is also preferably equipped with a handle member 34, which provides a convenient purchase for carrying the container 10, as well as another decorative feature to bolster the aesthetic quality of the container 10 of the present invention. In a preferred embodiment, the handle member 34 comprises an elongate braided rope having a first end 36 and a second end 38. The first end 36 of the handle member 34 is coupled to the article receptacle 12 by passing sequentially into a first hole 40, out a second hole 42 and back into a third hole 44 (the progression shown in phantom at 48), after which point it may be secured therewithin in any number of different fashions, including but not limited to tying the first end 36 in a knot so it cannot pass back through the third hole 44. The second end 38 of the handle member 34 is coupled to the article receptacle 12 by passing it through a fourth hole 46. Like the first end 36, once inserted through the wall of the box structure 16, the second end 38 may be secured therewithin in any number of different fashions, including but not limited to tying the second end 38 in a knot so it cannot pass back out of the fourth hole 46. It should be readily appreciated that the handle member 34 is to be coupled to the article receptacle 12 before the fabric liner 30 is affixed in covering relation over the buffer material 28. In this fashion, the handle member 34 may be quickly and easily attached to the article receptacle 12 without interference from or damage to the fabric liner 30. Each hole 40- 46 is preferably provided with grommet or sleeve-type members 50 which extend through the box structure 16 and fabric 20 to provide a smooth and aesthetically pleasing aperture through which the handle member 34 may pass. The grommet or sleeve-type members 50 also prevent the fabric 20 from becoming frayed or otherwise damaged due to the passage of the handle member 34 therethrough.

The lid member 14 of the present invention is similarly preferably equipped with a decorative exterior to augment the overall aesthetic quality and attractiveness of the container 10 of the present invention. The lid member 14 includes a lid structure 52 comprising a generally planar top member 54 and a side wall member 56 extending generally perpendicularly downward therefrom. According to a preferred embodiment of the present invention, the lid structure 52 is equipped with a decorative exterior by affixing or otherwise adhering a fabric 58 along the top member 54 and a fabric 60 along the side wall member 56. The fabric 58, 60 may be affixed or adhered to the lid structure 52 in any number of well known fashions, including but not limited to the use of glues, stitching, staples or any other mechanism suitable for securing the fabric 58, 60 to the lid structure 52. In each instance, the fabric 58, 60 is preferably provided with the decorative pattern 24. As set forth above (by way of example only), the decorative pattern 24 may take the form of a floral print, a striped print and/or a fruit print. The fabric 58, 60 may also be provided in any number of different colors or shades, including but not limited to white and ivory. To facilitate the positioning of the decorative fabric 58 on the lid structure 52, a lip 62 may be provided along the outer edge of the fabric 58 to wrap over the upper edge of the side wall 56. In similar fashion, the fabric 60 may be provided with a lip 64 along the lower edge of the fabric 60 to wrap over the lower edge of the side wall 56. Although the use of the fabric 58, 60 constitutes the preferred embodiment for creating a decorative appearance on the exterior of the lid structure 52, it is within the scope of the present invention to provide such a decorative exterior in any number of different fashions, including but not limited to painting, printing, or stamping decorative designs along the exterior of the lid structure 52. For clarity, the decorative pattern 24 is shown throughout only on selected portions of the lid member 14 and article receptacle 12. It is to be readily understood, however, that the decorative pattern 24 is preferably provided on the entire surface of the fabric 20, 22 on the article receptacle 12 and the fabric 58, 60 on the lid member 14.

To further augment the decorative features of the container 10 of the present invention, a bow 66 may be optionally provided on the top of the lid member 14, preferably at or near the proximate center of the lid member 14. In the embodiment shown, the bow 66 is affixed to the lid member 14 using a U-shaped staple-type member 68 designed to extend about either side of a central portion 70 of the bow 66 and into corresponding apertures 72, 74 in the lid member 14 to thereby maintain the bow 66 in position against the lid member 14. It should be readily understood that this manner of fastening the bow 66 to the lid member 14 is set forth by way of example only, and that any number of other known fastening mechanisms may be employed without departing from the scope of the present invention, including but not limited to the use of glues and stitching. The bow 66 is preferably constructed of tulle; however, skilled artisans will readily appreciate that it is within the scope of the present invention to use any number of additional or substitute materials to construct the bow 66. It should also be readily appreciated that the bow 66 may be provided in any of a variety of different colors and shades without departing from the scope of the invention, including but not limited to ivory or white.

Figure 2:
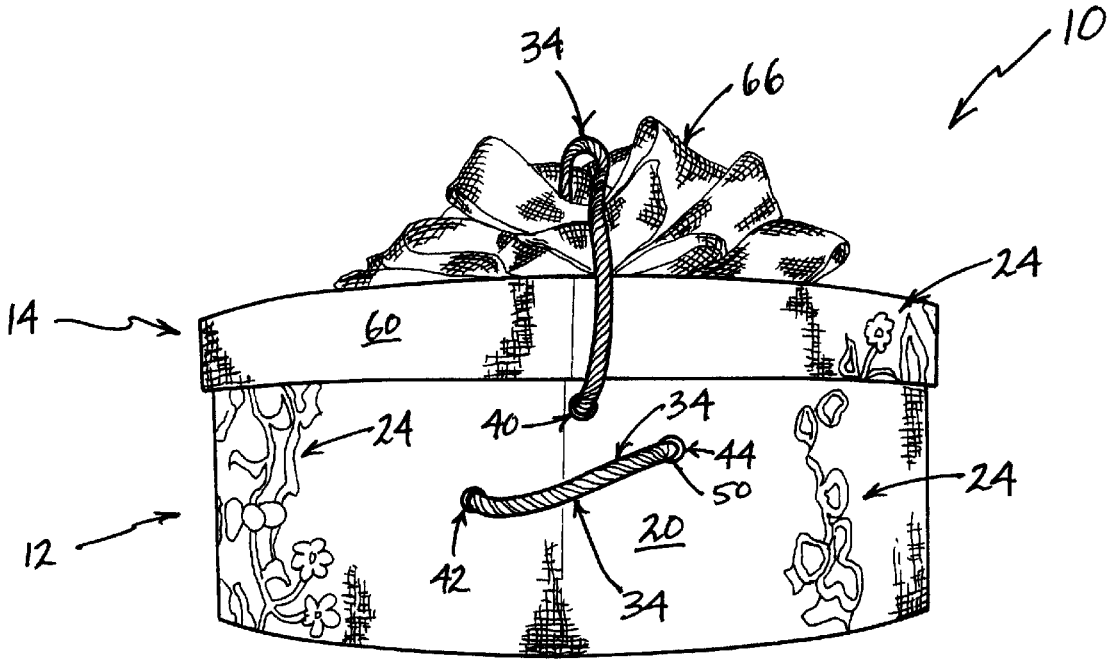
FIG. 2 is a side view of the heart-shaped decorative container shown in FIG. 1 illustrating the front side (apex region) of the heart-shaped decorative container.
Figure 3:
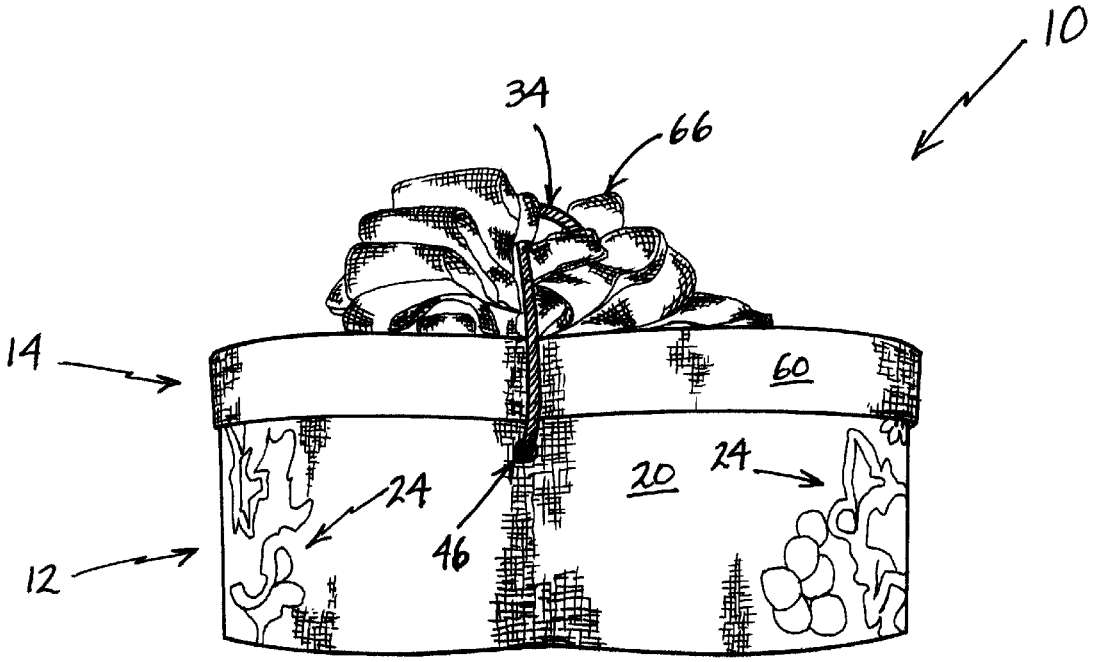
FIG. 3 is a side view of the heart-shaped decorative container shown in FIG. 1 illustrating the back side (cleaved region) of the heart-shaped decorative container.
Figure 4:
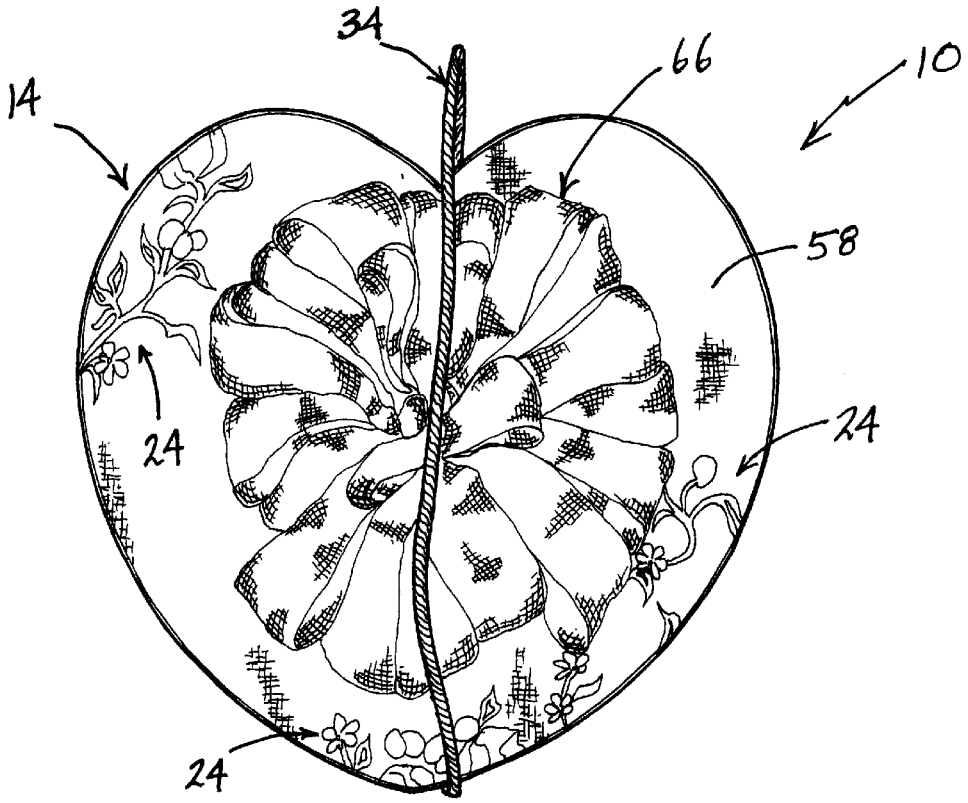
FIG. 4 is a top view of the heart-shaped decorative container shown in FIG. 1.
Figure 5:
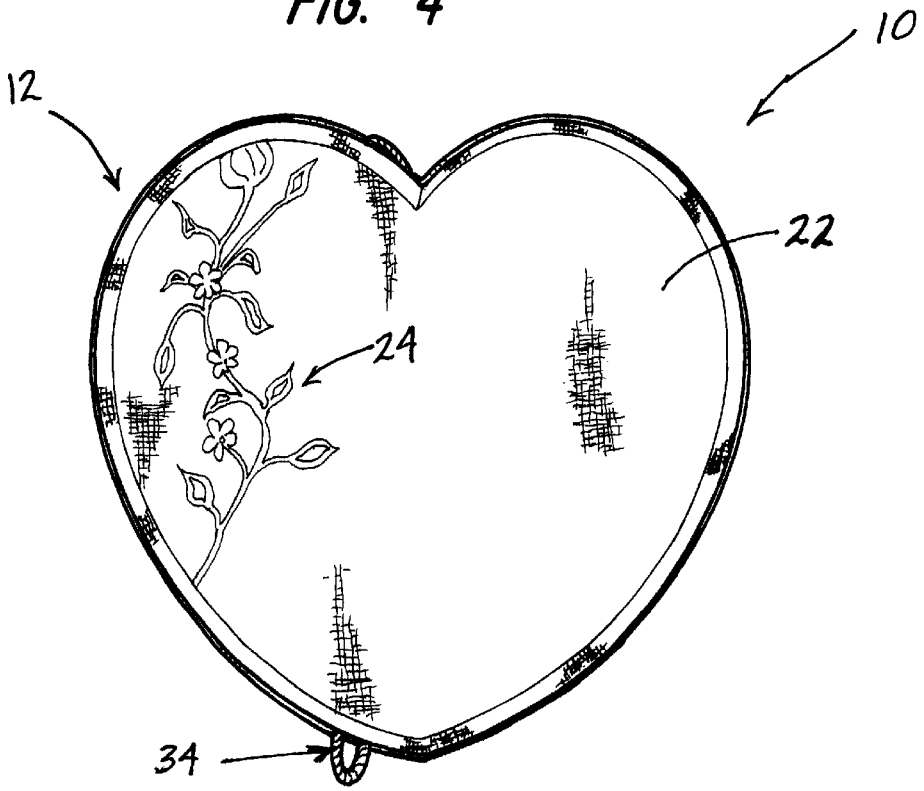
FIG. 5 is a bottom view of the heart-shaped decorative container shown in FIG. 1.
Figure 6:
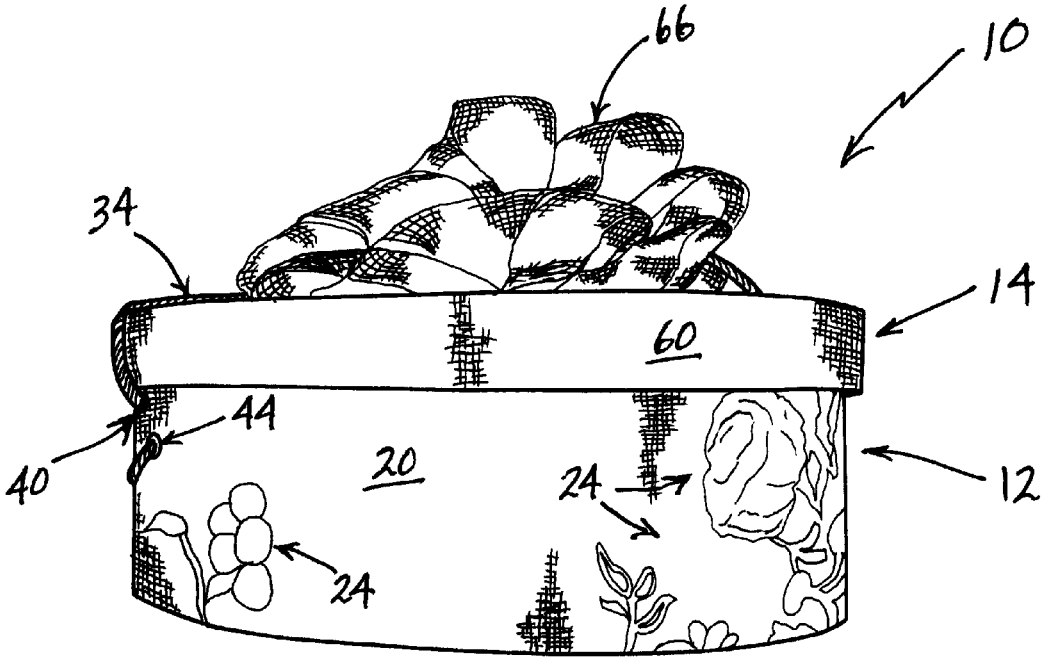
FIG. 6 is a side view of the heart-shaped decorative container shown in FIG. 1 illustrating the right side of the heart-shaped decorative container.
Figure 7:
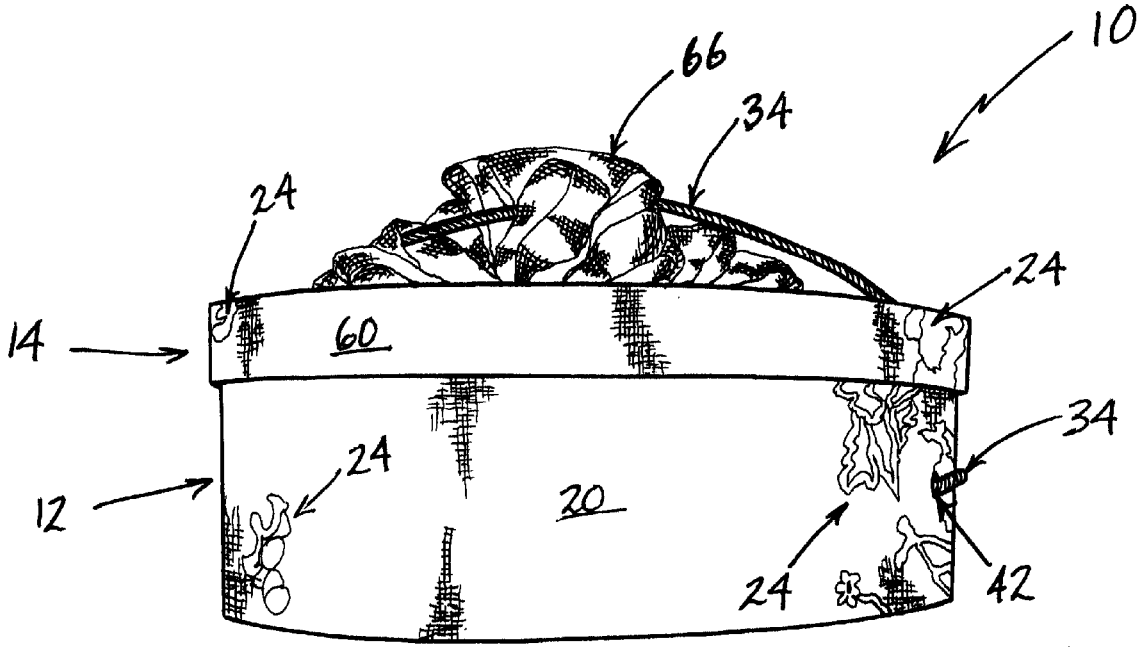
FIG. 7 is a side view of the heart-shaped decorative container shown in FIG. 1illustrating the side of the heart-shaped decorative container.

FIGS. 2–7 provide various views of the container 10 of the present invention with the lid member 14 disposed on the article receptacle 12. FIG. 2 is a side view illustrating the front side (apex region) of the heart-shaped decorative container 10. FIG. 3 is a side view illustrating the back side (cleaved region) of the heart-shaped decorative container 10. FIG. 4 is a top view of the heart-shaped decorative container 10. FIG. 5 is a bottom view of the heart-shaped decorative container 10. FIG. 6 is a side view illustrating the right side of the heart-shaped decorative container 10. FIG. 7 is a side view illustrating the left side of the heart-shaped decorative container 10. Although shown draped over the approximate middle of the lid member 14, it will be readily understood that the handle member 34 may be provided so as to rest in any number of different configurations relative to the lid member 14 and/or article receptacle 12. For example, the handle member 34 may be optionally positioned to rest in a generally flush fashion along the side of the article receptacle 12.

Figure 8:
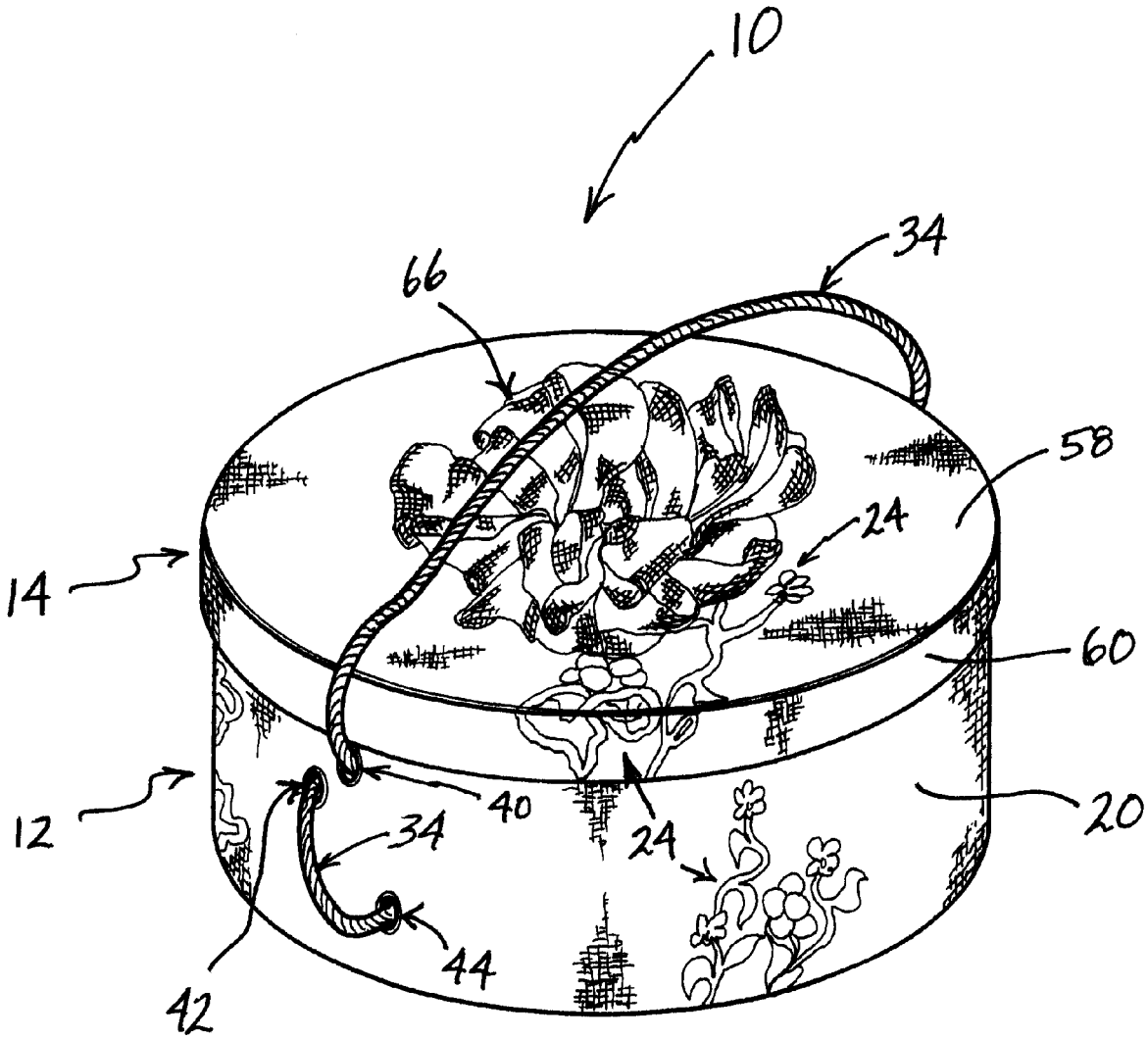
FIG. 8 is a perspective view of a decorative container having a generally round shape according to one embodiment of the present invention.
Figure 9:
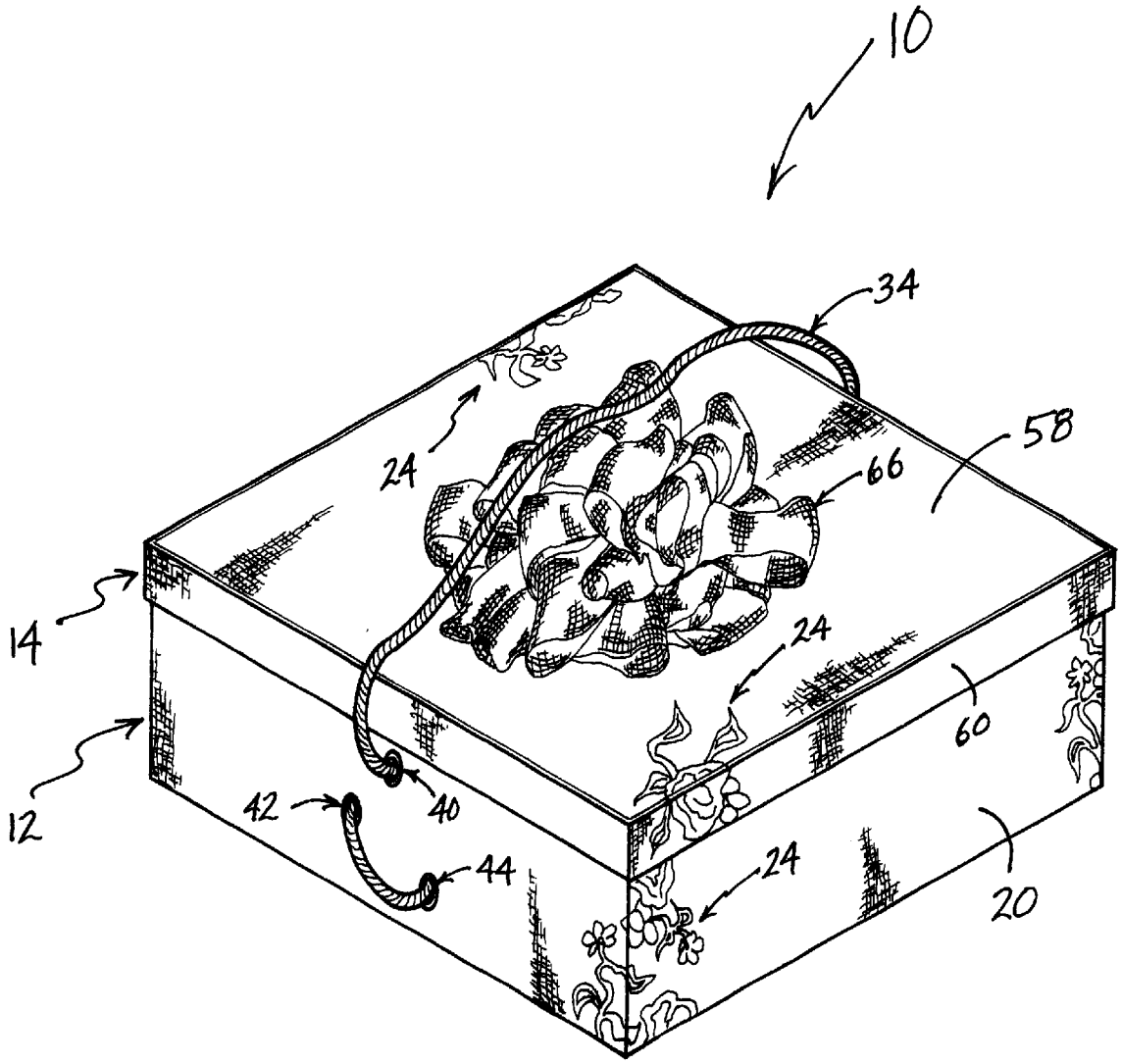
FIG. 9 is a perspective view of a decorative container having a generally square shape according to the embodiment of the present invention.
Figure 10:
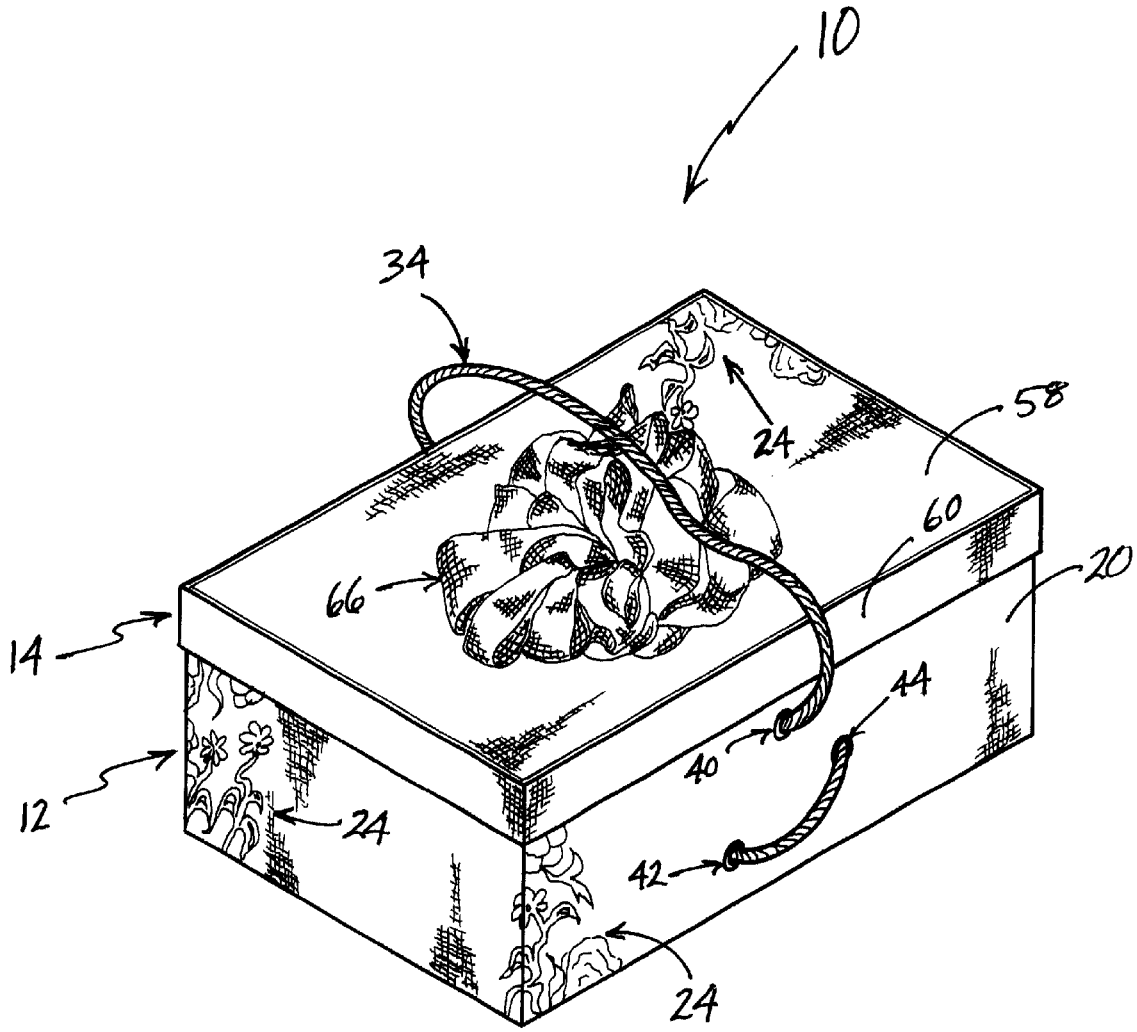
FIG. 10 is a perspective view of a decorative container having a generally rectangular shape according to one embodiment of the present invention.
Figure 11:
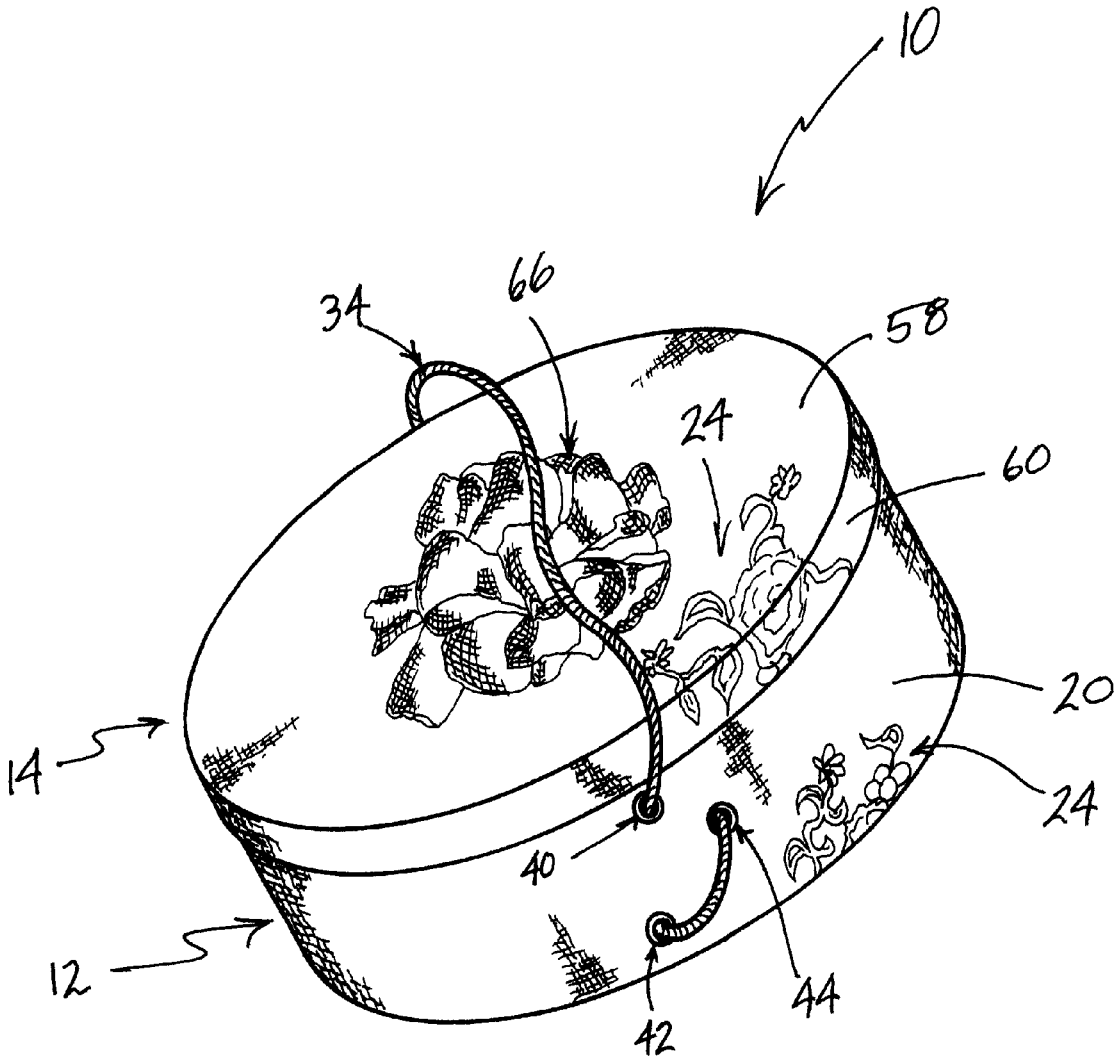
FIG. 11 is a perspective view of a decorative container having a generally oval shape according to one embodiment of the present invention.

The decorative container 10 of the present invention may also be provided in any number of different shapes without departing from the scope of the present invention. By way of example and not limitation, FIGS. 8–11 illustrate the decorative container 10 of the present invention configured in various alternate shapes. FIG. 8 illustrates the decorative container 10 of the present invention having a generally round shape. FIG. 9 illustrates the decorative container 10 having a generally square shape. FIG. 10 illustrates the decorative container 10 having a generally rectangular shape. FIG. 11 illustrates the decorative container 10 having a generally oval shape. Although not shown, it is to be readily understood that the decorative container 10 of the present invention may be provided in any number of additional shapes not specifically shown, and that these additional shapes fall squarely within the scope of the present invention.

The decorative container 10 overcomes the drawbacks in the prior art. In all embodiments, the decorative container 10 of the present invention boasts superior aesthetic qualities and attractiveness, as well as superior protective features to ensure that any articles disposed therein do not become damaged during transportation or storage. The decorative features provided on the exterior and interior of the article receptacle 12 make it ideal for use in receiving gift cards brought by attendees during special events, including but not limited to weddings, anniversary parties, baptisms, birthday parties, bat mitzvahs, bar mitzvahs, wedding and/or baby showers. The protective features of the inside of the article receptacle 12 also make it ideal for use in receiving gift cards, as well as long-term storage of other keepsakes from the particular special event. Such keepsakes may include, by way of example only, jewelry, garters, gift cards, certificates., and/or cake toppers, such as from a wedding. In addition to providing a safe and protective environment to maintain such keepsakes following the special event, the container 10 of the present invention is also suitably attractive to be placed prominently for public viewing.

The foregoing embodiments meet the objectives of this invention as stated above. Since numerous modifications and changes will readily occur, it is not desired to limit the invention to the exact construction shown and described. Thus, all suitable modifications and equivalents may be resorted to, falling within the scope and spirit of the invention.

What is claimed is:

1. A container, comprising:

an article-receptacle having at least one wall member extending from a bottom member defining an outside surface and an inside surface, said outside surface of said article-receptacle being equipped with a decorative covering, and said inside surface of said article-receptacle being equipped with a decorative and protective covering such that said article-receptacle may be employed during special events to receive gift cards brought by attendees of said special event, said decorative and protective covering including a buffer material disposed along at least a bottom portion of said inner surface and a decorative fabric disposed over said buffer material; and a lid member dimensioned to fit over said article-receptacle to selectively maintain said gift cards and other keepsake articles from said special event in a secure fashion therewithin, said lid member having a decorative covering.

2. The container of claim 1 and further, wherein said buffer material comprises polyester fiber.

3. The container of claim 1 and further, wherein said decorative fabric comprises a satin.

4. The container of claim 3 and further, wherein said satin comprises a Celanese acetate satin.

5. The container of claim 1 and further, wherein said decorative covering on said lid member and said outside surface of said article-receptacle comprises a fabric having a decorative print formed thereon, said decorative print being at least one of a floral print, a striped print, and a fruit print.

6. The container of claim 5 and further, wherein said decorative print is provided in at least one of an ivory color and a white color.

7. The container of claim 1 and further, wherein said article-receptacle is provided with lace along an upper edge of said decorative fabric disposed within said article-receptacle.

8. The container of claim 1 and further, wherein said lid member is provided with a decorative bow.

9. The container of claim 8 and further, wherein said decorative bow is constructed from tulle.

10. The container of claim 1 and further, wherein said article-receptacle includes a handle member coupled to said wall member.

11. The container of claim 10 and further, wherein said handle member comprises an elongate rope member.

12. A container for storing keepsake articles from a special event, comprising:

an article-receiving member having an outside surface and an inside surface, said inside surface defining an article-receiving portion therein, said outside surface having a decorative appearance, and said inside surface having a decorative and protective covering such that said article-receiving portion is attractive and serves to protect keepsake articles disposed therein during transportation, said decorative and protective covering including a buffer material disposed along at least a bottom portion of said inner surface and a decorative fabric disposed over said buffer material; and a lid member for selectively covering said article-receiving member to selectively maintain said keepsake articles in a safe and protected condition within said article-receiving portion.

13. The container of claim 12 and further, wherein said buffer material comprises polyester fiber.

14. The container of claim 12 and further wherein said decorative fabric comprises a satin.

15. The container of claim 14 and further, wherein said satin comprises a Celanese acetate satin.

16. The container of claim 12 and further, wherein the decorative fabric includes at least one of a floral print, a striped print, and a fruit print.

17. The container of claim 12 and further, wherein said decorative fabric is provided in at least one of an ivory color and a white color.

18. The container of claim 12 and further, wherein said article-receiving member is provided with lace along an upper edge of said decorative fabric disposed over said buffer material within said article-receiving portion.

19. The container of claim 12 and further, wherein said lid member is provided with a decorative bow.

20. The container of claim 19 and further, wherein said decorative bow is constructed from tulle.

21. The container of claim 12 and further, wherein said article-receiving member includes a handle member.

22. The container of claim 21 and further, wherein said handle member comprises an elongate rope member.

23. A method of manufacturing a container for use in storing keepsake articles from a special event, comprising the steps of:

providing an article-receptacle having at least one wall member extending from a bottom member defining an outside surface and an inside surface;

equipping said outside surface of said article-receptacle with a decorative covering;

equipping said inside surface of said article-receptacle with a decorative and protective covering for receiving and protecting keepsake articles from said special event;

providing a lid member dimensioned to fit over said article-receptacle to selectively maintain said keepsake articles from said special event in a secure fashion therewithin during transportation or storage; and equipping said lid member with a decorative covering.

24. A method of manufacturing a container for use in storing keepsake articles from a special event, comprising the steps of:

providing an article-receptacle having at least one wall member extending from a bottom member defining an outside surface and an inside surface;

equipping said outside surface of said article-receptacle with a decorative covering;

equipping said inside surface of said article-receptacle with a decorative and protective covering for receiving and protecting keepsake articles from said special event, said decorative and protective covering including a buffer material disposed along at least a bottom portion of said inside surface and a decorative fabric disposed over said buffer material;

providing a lid member dimensioned to fit over said article-receptacle to selectively maintain said keepsake articles from said special event in a secure fashion therewithin during transportation or storage; and equipping said lid member with a decorative covering.

25. An article receptacle for receiving gift cards or keepsake articles from special events, comprising:

at least one wall member extending from a bottom member defining an outside surface and an inside surface, said outside surface being equipped with a decorative covering, and said inside surface being equipped with a decorative and protective covering dimensioned to receive gift cards or keepsakes from special events, said decorative and protective covering including a buffer material disposed along at least a bottom portion of said inner surface and a decorative fabric disposed over said buffer material.

26. A method of manufacturing an article receptacle for receiving gift cards or keepsake articles from special events, comprising the steps of:

providing at least one wall member extending from a bottom member defining an outside surface and an inside surface;

equipping said outside surface with a decorative covering; and equipping said inside surface with a decorative and protective covering dimensioned to receive gift cards or keepsakes from special events, said decorative and protective covering including a buffer material disposed along at least a bottom portion of said inner surface and a decorative fabric disposed over said buffer material.

27. The container of claim 12 and further, wherein said lid member has a decorative appearance.

28. The container of claim 27 and further, wherein said decorative appearance of said lid member and said outside surface of said article-receiving member is created by placing a decorative fabric on said lid member and said outside surface of said article-receiving member, respectively.

29. The article receptacle of claim 25 and further including a lid member having a decorative appearance.

30. The article receptacle of claim 29 and further, wherein said decorative appearance of said lid member and said outside surface of said article-receiving member is created by placing a decorative fabric on said lid member and said outside surface of said article-receiving member, respectively.

31. The article receptacle of claim 25 and further, wherein said buffer material comprises polyester fiber.

32. The article receptacle of claim 25 and further, wherein said decorative fabric comprises a satin.

33. The article receptacle of claim 32 and further, wherein said satin comprises a Celanese acetate satin.

34. The article receptacle of claim 25 and further, wherein the decorative fabric includes at least one of a floral print, a striped print, and a fruit print.

35. The article receptacle of claim 25 and further, wherein said decorative fabric is provided in at least one of an ivory color and a white color.

36. The article receptacle of claim 25 and further, wherein lace is provided along an upper edge of said decorative fabric disposed over said buffer material.

37. The article receptacle of claim 29 and further, wherein said lid member is provided with a decorative bow.

38. The article receptacle of claim 37 and further, wherein said decorative bow is constructed from tulle.

39. The article receptacle of claim 25 and further, including a handle member coupled to said at least one wall member.

40. The article receptacle of claim 39 and further, wherein said handle member comprises an elongate rope member.

41. The method of manufacturing an article receptacle of claim 26, including the further step of providing a lid member having a decorative appearance.

42. The method of manufacturing an article receptacle of claim 41 and further, wherein said decorative appearance of said lid member and said outside surface of said article-receiving member is created by placing a decorative fabric on said lid member and said outside surface of said article-receiving member, respectively.

43. The method of manufacturing an article receptacle of claim 26 and further, wherein said buffer material comprises polyester fiber.

44. The method of manufacturing an article receptacle of claim 26 and further, wherein said decorative fabric comprises a satin.

45. The method of manufacturing an article receptacle of claim 44 and further, wherein said satin comprises a Celanese acetate satin.

46. The method of manufacturing an article receptacle of claim 26 and further, wherein the decorative fabric includes at least one of a floral print, a striped print, and a fruit print.

47. The method of manufacturing an article receptacle of claim 26 and further, wherein said decorative fabric is provided in at least one of an ivory color and a white color.

48. The method of manufacturing an article receptacle of claim 26 and further, comprising the step of providing lace along an upper edge of said decorative fabric disposed over said buffer material.

49. The method of manufacturing an article receptacle of claim 41 and further, comprising the step of providing said lid member with a decorative bow.

50. The method of manufacturing an article receptacle of claim 49 and further, wherein said decorative bow is constructed from tulle.

51. The method of manufacturing an article receptacle of claim 26 and further, comprising the step of equipping said at least one wall member with a handle member.

52. The method of manufacturing an article receptacle of claim 51 and further, wherein said handle member comprises an elongate rope member.

* * * * *